United States Patent [19]

Helmer, Jr.

[11] 4,165,726

[45] Aug. 28, 1979

[54] LOW MASS BREAKERLESS IGNITION DISTRIBUTOR

[75] Inventor: Harry W. Helmer, Jr., Detroit, Mich.

[73] Assignee: Chrysler Corporation, Highland Park, Mich.

[21] Appl. No.: 839,529

[22] Filed: Oct. 5, 1977

[51] Int. Cl.[2] ..... F02P 7/00

[52] U.S. Cl. ..... 123/146.5 A; 123/148 E; 310/70 R; 200/19 DR; 200/19 M

[58] Field of Search ..... 123/146.5 A, 146.5 R, 123/148 R, 148 F; 310/70 R, 70 A; 200/19 R, 19 DR, 19 M, 24

[56] References Cited

U.S. PATENT DOCUMENTS

| | | | |
|---|---|---|---|
| 2,084,267 | 6/1937 | Hicks | 123/146.5 A |
| 3,206,565 | 9/1965 | Lingenfelter | 200/19 DR |
| 3,258,550 | 6/1966 | Guetersloh et al. | 200/19 M |
| 3,542,976 | 11/1970 | Moray | 123/146.5 A |
| 3,822,686 | 7/1974 | Gallo | 123/146.5 A |
| 3,861,370 | 1/1975 | Howard | 123/148 E |
| 3,875,920 | 4/1975 | Williams | 123/148 E |
| 3,906,920 | 9/1975 | Hemphill | 123/148 E |
| 3,976,044 | 8/1976 | Madeira et al. | 123/148 E |
| 4,011,476 | 3/1977 | Beard | 123/148 R |
| 4,037,577 | 7/1977 | Gallo | 123/146.5 A |

*Primary Examiner*—Charles J. Myhre
*Assistant Examiner*—Andrew M. Dolinar
*Attorney, Agent, or Firm*—Baldwin & Newtson

[57] ABSTRACT

An automotive type ignition distributor featuring a Hall Effect pickup and associated electronic circuitry and a combined distributor rotor and interrupter unit, which distributes the high tension energy to the spark plugs of the engine, acts as an interrupter for the Hall Effect Pickup and provides a return circuit path to ground for electrostatic charges developed within the distributor to protect the semiconductor components within the distributor from damage due to arc flashover.

11 Claims, 9 Drawing Figures

LOW MASS BREAKERLESS IGNITION DISTRIBUTOR

FIELD AND BACKGROUND OF THE INVENTION

This invention relates to a low mass-breakerless ignition distributor as may be used with internal combustion engines for compact and sub-compact automotive vehicles, for example.

Reduced available space and necessary weight reduction considerations dictate that such distributors be of compact size and employ light weight, stable components capable of holding adjustment and alignment and of withstanding the high shock and vibration encountered in the engine compartments of four cylinder automotive vehicles.

For the above and other reasons and the trend towards the increasing use of electronic ignition systems in motor vehicles, the distributors for such applications preferably ought to be of the breakerless variety and to employ electrical or electronic sensor, pickup trigger or timing signal generating devices, which may include semiconductor detecting, switching and/or signal processing circuitry provided therewith within the distributor housing.

The electrical and physical characteristics of such pickup devices, however, render them particularly vulnerable to damage due to the corrosive environment and electrostatic charges developed by the highly charged and ionized atmosphere, which exists within the interior of the distributor housing and may be conducive to arcing and arc flash-over from the distributor rotor electrode to the pickup.

Accordingly, the present invention seeks to provide a breakerless ignition distributor, which is of low mass, light weight and stable construction for use in high shock and vibration environments encountered in such automotive engines.

Related objects are to provide a breakerless distributor, which has an electronic pickup and associated circuitry within the distributor housing and which includes mechanical and electrical constructional features to protect the pickup structure from mechanical and electrical damage and reduce the possibility of accidental flashover thereto.

Other objects are to provide a breakerless ignition distributor, which is of simple, inexpensive and compact construction, is composed of a minimum number of parts, and may be readily assembled and disassembled for inspection, repair and replacement of the components thereof.

SUMMARY

According to the present invention, there is provided a low mass, breakerless ignition distributor, which uses a Hall Effect switch or electrical pickup and associated electrical and solid state electronic circuitry contained in an encapsulated module integrally formed on an insulated timing or base plate within the distributor housing. The distributor also features a one piece distributor rotor unit comprising a thin insulate disc member, which is readily detachably received on one end of the engine driven rotor shaft and carries a rotor distributor blade on one side thereof, and a ferrous metallic, rigid stiffener or reinforcement plate, which is molded in and carried on the other side of the rotor disc. The stiffener plate has a number of integrally formed, circumferentially spaced interrupter vanes depending therefrom into the space between the magnet and Hall Sensor element of the pickup structure of which the Hall Sensor element is disposed radially outwardly of the magnet and the interrupter vanes. The stiffener plate further includes an integrally formed grounding tab connection, which contacts the steel rotor shaft of the distributor when the rotor unit is mounted in place on the end of the rotor shaft, so that the interrupter vanes and the stiffener plate can be electrically grounded through the rotor shaft to divert any arc flashover, which may occur within the distributor cap, away from the pickup structure and to conduct it instead, through the grounded interrupter vanes and rotor shaft, thereby to protect the pickup structure and electronic circuitry within the distributor against damage from such arcing.

The above and other objects, advantages and features of the invention will appear more fully from consideration of the following detailed description, made with reference to the accompanying drawings.

DESCRIPTION OF THE PREFERRED EMBODIMENT

Figures 1, 4:
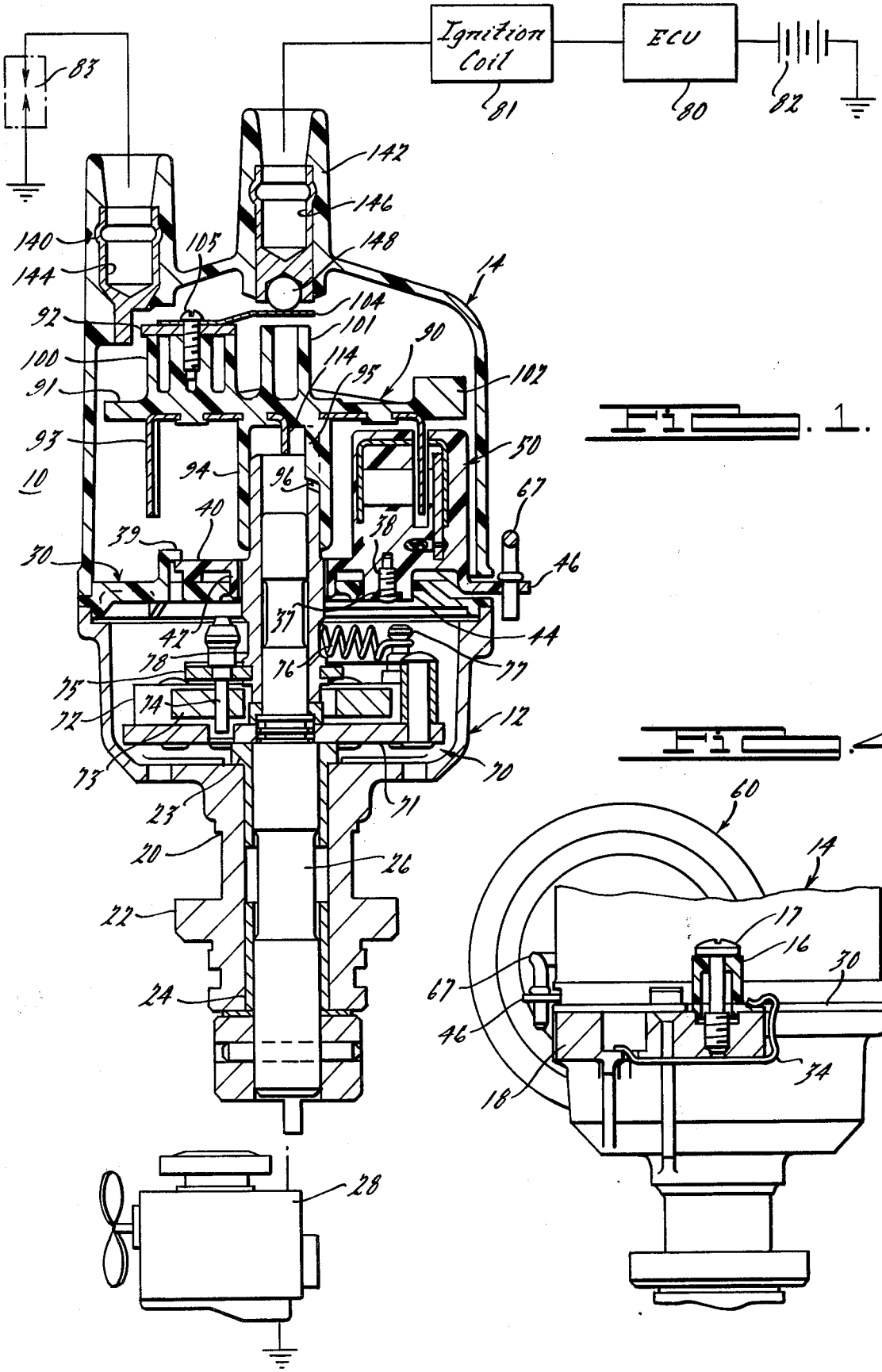
FIG. 1 is a vertical sectional elevational view of a low mass, breakerless ignition distributor in accordance with the present invention.
FIG. 4 is a vertical sectional view with parts broken away and taken in the direction 4—4 of FIG. 2.
Figure 2:
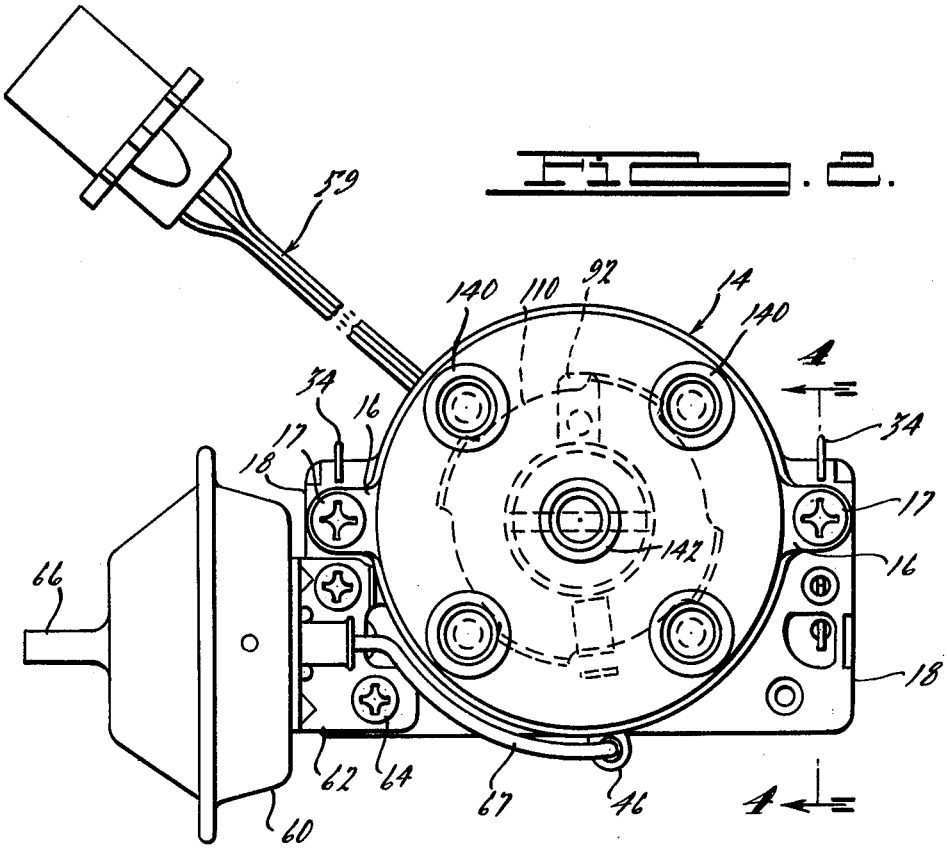
FIG. 2 is a top plan view of the distributor of FIG. 1.

As shown in FIGS. 1 and 2 of the drawings, the distributor 10 comprises a cylindrical bowl-shaped, machined housing 12, which is formed of cast aluminum material, and a towered dome-shaped distributor cap 14, which is formed of electrically insulative, thermal plastic, polyester material exhibiting high mechanical strength and impact qualities and high electrical dielectric characteristics. The distributor cap has a pair of upstanding, diametrically oppositely disposed, integrally formed ears or posts 16 thereon by which it may be releasably attached by threaded and cross-slotted screws 17 to a flanged rectangular platform portion 18, which is integrally, but asymmetrically formed at the upper end of the housing. Extending downwardly from the bowl-shaped housing is an integrally formed tubular shank or stem portion 20 with a stepped mounting flange 22 at its lower end, which is received in an opening (not shown) in and is suitably secured to the engine block. Stem portion 20 includes an upper thrust bearing 23 and a lower sleeve bearing 24 in which is journalled the distributor rotor shaft 26, which is formed of machined steel and is suitably coupled to and is rotatably driven from the electrically grounded engine, depicted diagrammatically at 28 herein.

Figure 3:
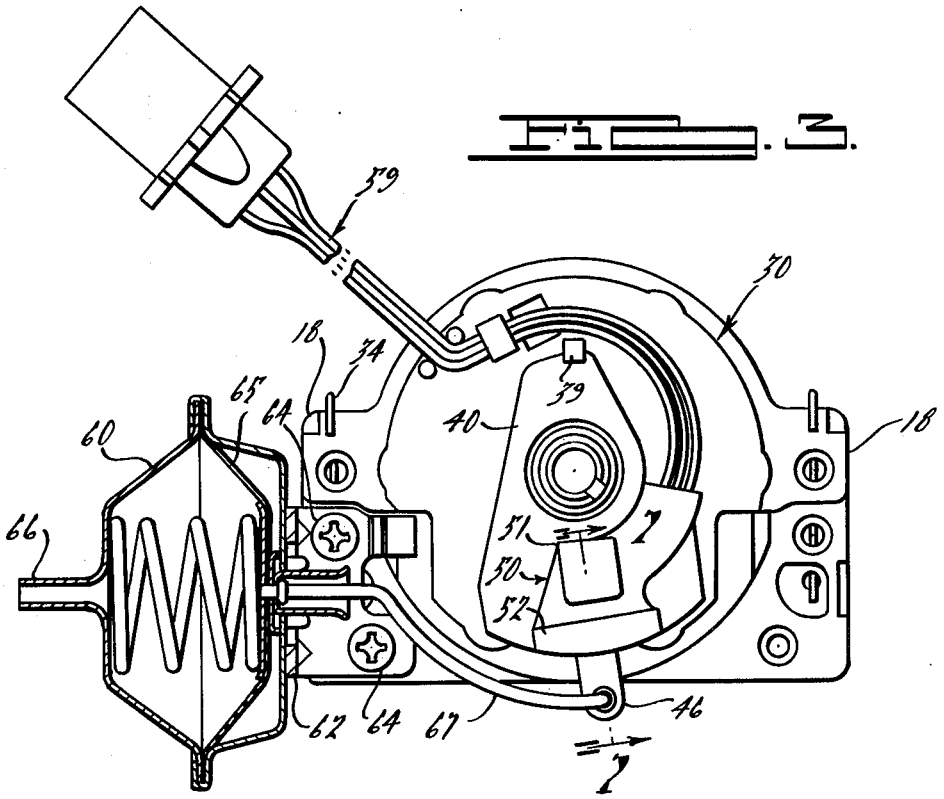
FIG. 3 is a plan view of the distributor of FIG. 1 with the distributor cap and the distributor rotor unit removed.
Figure 5:
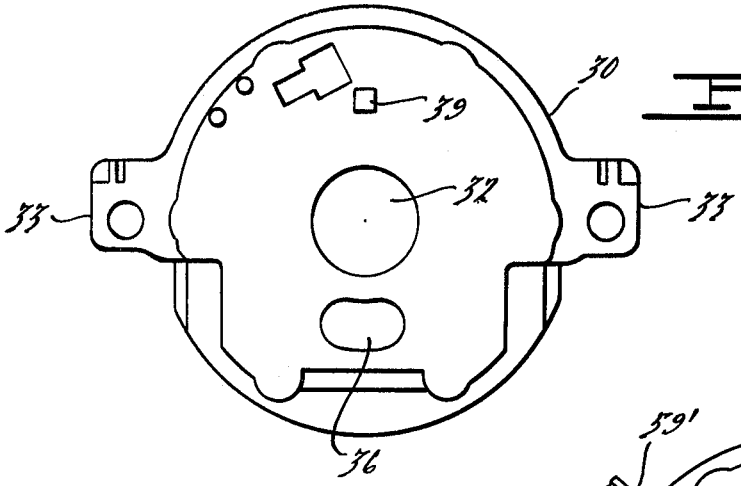
FIG. 5 is a top plan view of a base plate component employed in the distributor of FIGS. 1 and 3 in which the spark timing is mechanically advanced.

Covering the upper end of the bowl-shaped housing 12 is a generally circularly-shaped stationary base plate 30, which carries a moveable timing plate 40 thereon. Plate 30 has a centrally located aperture 32 therein and is formed with a pair of diametrically oppositely disposed apertured ears 33 thereon underlying the raised mounting posts 16 on the distributor cap, as shown in FIGS. 3, 4 and 5 herein. The threaded attachment screws 17 extend through and secure the distributor cap 14 and base plate 30 to the platform portion 18 of the housing 12 to which the base plate is further releasably attached by spring clips 34.

Timing plate 40, which carries the magnet and Hall Sensor element of the pickup assembly 50 thereon, is formed of a plastic material as the distributor cap 14 and base plate 30 and has a central aperture therein surrounded by a short collar or sleeve 42 shown in FIG. 1 herein. Sleeve 42 projects axially downwardly from the lower side of the timing plate and is received within the central aperture 32 of the base plate 30 in which the timing plate is thus mounted for pivotal movement about the central axis of the distributor. An integrally formed circular boss 44 projecting from the lower side of the timing plate 40 is received in an elongated arcuate slot 36, (FIG. 5), which is provided in the base plate 30 against which the timing plate is resiliently yieldably held by a thin spring slip or strip 37 that is located on the underside of the timing plate and is secured to the boss 44 by an attachment screw 38. An integrally formed tab 39 on the upper surface of the base plate 30 overhangs the innermost end of the timing plate and holds it against the base plate, while allowing arcuate movement of the timing plate thereon.

In the embodiment shown in FIG. 1, movement of the timing plate 40 is effected from a vacuum actuator unit 60 coupled to an ear 46, which is integrally formed on the outermost end of the timing plate and extends radially through the distributor cap. As shown in FIGS. 2 and 3, the actuator 60 is of the double chamber, spring biased, diaphragm-operated variety and has an L-shaped mounting bracket 62 secured thereto by which it is detachably mounted to the housing platform portion 18, as by mounting screws 64.

One chamber or side of the flexible, impervious diaphragm 65 is exposed to a source of engine vacuum, which is conducted thereto and applied to a centrally located tubular spout or stem 66 thereon. The other chamber, or atmospherically exposed side of the diaphragm, is connected to an actuator bail or link 67 having a short straight section and a longer arcuate section, which curves around an external portion of the distributor cap and is hooked to the ear 46 on the timing plate 40 for movement of the latter in a direction to advance the engine spark timing with increasing engine vacuum.

Below the plates 30 and 40 is located the centrifugally operated governor mechanism 70 shown in FIG. 1. The governor mechanism is rotatively driven from the rotor shaft 26 and includes a governor weight support plate 71, which is fixed to the rotor shaft, and a pair of sintered powder metal stops or cam blocks 72, which are fixedly mounted on the support plate and bear against the governor weights one of which is shown at 73. The governor weights 73, which are also formed of powdered metal, are pivotally and swingably mounted on diametrically opposed, vertically extending pins, one of which is shown at 74, carried on and fixed to a rotatable flange plate 75 located above the support plate 71. The upper end of each pin extends through the flange plate 75 to provide a mounting post or anchor for one end of a different one of a pair of governor springs, one of which is shown at 76 and is provided for each governor weight. The other end of each spring is fastened to a different one of a pair of upstanding anchor posts, one of which is shown at 77, each secured to a different one of the cam blocks 72. Plate 75 is fixed to the lower end of a tubular metallic sleeve 78, which surrounds and receives the rotor shaft 26 and is relatively rotatably movable thereon by the movement of the governor weights to adjust the angular position of the sleeve 78 relative to the rotor shaft 26 in a direction to advance the engine spark timing with increasing engine speed.

Figure 6:
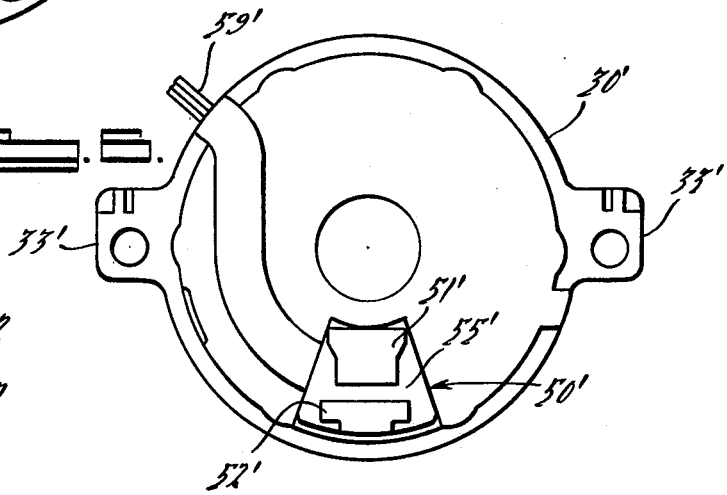
FIG. 6 is a top plan view of another form of base plate mounting component with an integrally formed Hall Sensor pickup structure for use in a distributor in which the spark timing is electronically advanced.
Figure 7:
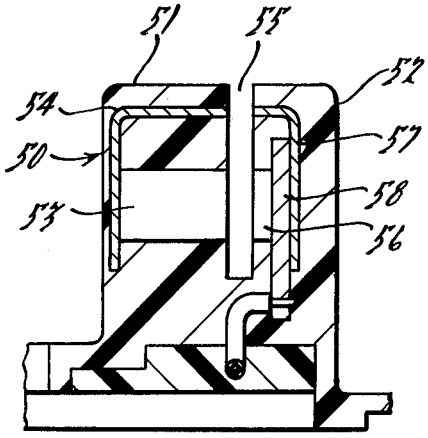
FIG. 7 is an enlarged, vertical sectional elevation view with parts broken away taken in the direction 7—7 of FIG. 3.

The pickup or sensor assembly 50 is preferably of the Hall Effect variety, the components of which are encapsulated in a pair of upstanding, spaced apart protuberances 51 and 52, which are integrally formed on the molded timing plate 40 employed with the mechanically spark advanced distributor of FIG. 1. Where the spark timing is electronically advanced, the timing plate 40 is eliminated and the pickup structure 50 provided on the stationary base plate 30', as shown in FIG. 6. In such case, the vacuum actuator unit 60 and the governor mechanism 70, including the sleeve 78, would also be eliminated from the distributor structure.

The innermost or inwardly located protuberance 51 of the pickup structure 50 contains a radially extending bar magnet 53 and an inverted, L-shaped pole piece 54, which is affixed to one end and overhangs the other or free end of the magnet. The outwardly located protuberance 52 is spaced and separated from the protuberance 51 by a slot or air gap 55 and contains the magnetic field responsive Hall element 56 and another inverted L-shaped pole piece 57, which is located radially outwardly behind and overhangs the Hall element pole piece 57 has an inwardly extending pole face, which confronts and is aligned with the outwardly extending pole face of pole piece 54 and is spaced therefrom by the width of the slot or air gap 55 between the free end or pole of the magnet 53 and the Hall element 56. Hall element 56 is mounted on a ceramic substrate 58 and is located directly in the path of the magnetic flux or field of the permanent magnet 53 in a magnetic circuit, which extends from the free end or pole of the magnet radially outwardly across the air gap and through the Hall element and pole piece 57 and then radially inwardly across the air gap between the aligned pole faces of pole pieces 57 and 54 and back through pole piece 54 to the other pole of the magnet.

The ceramic substrate 58 also carries the electronic voltage regulating, signal shaping, amplifying and processing circuitry, which is associated with the Hall Sensor and may be of the character referenced in U.S. Pat. No. 3,875,920 for example. A three conductor harness 59, a part of which is encapsulated within the timing plate 40 of FIG. 3 or the base plate 30 of FIG. 6, is connected to the Hall element and semiconductor circuitry provided as an integrated semiconductor circuit chip on the substrate 58. The harness supplies the necessary operating voltage to the circuitry on the substrate and conveys the electrical switching signal derived therefrom to an externally located electronic control or switching unit diagrammatically depicted at 80 in FIG.

1 herein. For the mechanically advanced distributor, the electronic control unit 80 may be of the character shown for example in U.S. Ser. No. 743,021, now U.S. Pat. No. 4,106,460 or 743,824, both filed Nov. 18, 1976, while, for the electronically advanced distributor, the control unit may be of the character shown in U.S. Ser. No. 752,490 filed Dec. 20, 1976, all of common ownership herewith. The control unit 80, of course, controls the energization and deenergization of the ignition coil 81 from a source of low tension energy, shown as the negatively grounded vehicle battery 82 to develop the electrical high tension to the engine spark plug to ignite the combustable mixture within the engine cylinders and power the engine.

The high tension energy is sequentially distributed to the engine spark plugs 83 by the distributor rotor unit 90, which is readily detachably received and mounted on the upper end of the governor mechanism-actuated tubular sleeve 78 extending through the centrally apertured base plate 30 and timing plate 40. The rotor unit also carries interrupter structure cooperating with the pickup or Hall Sensor for switching the signal developed by the Hall element in synchronism with the rotation of the distributor rotor shaft by the engine.

Figure 8:
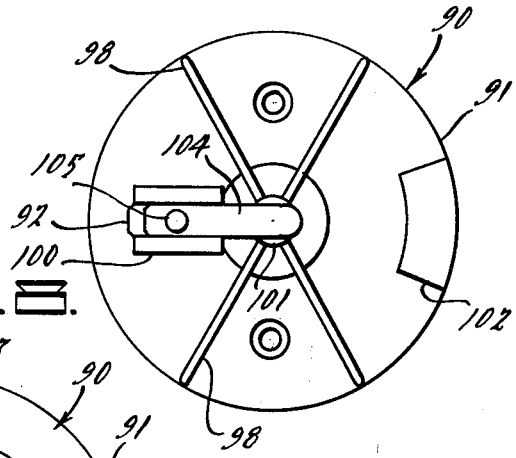
FIG. 8 is a top plan view of the distributor rotor unit employed in the distributor of FIG. 1.
Figure 9:
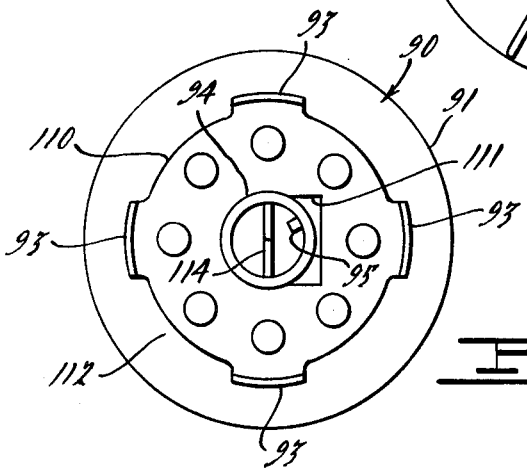
FIG. 9 is a bottom view of the distributor rotor unit of FIG. 8.

As shown in FIGS. 1, 8 and 9, the distributor rotor unit 90 is a unitary or one piece structure including a molded disc member 91, which carries an electrically conductive rectangular-shaped distributor blade electrode 92 on one side thereof and a circular array of metallic interrupter vanes 93 on its flat other or lower side. Disc 91 is a comparatively thin member, which is formed of electrically insulative thermal plastic polyester material of a thickness of from five percent (5%) to approximately 10% or less than its diameter, and has an integrally formed, centrally located tubular sleeve 94, which projects axially downwardly from the flat lower surface thereof and slips over to be received on the upper end of the rotor sleeve 78 in close fitting relation therewith. An integrally formed rib or spline 95 located internally of the sleeve 94 is received within a keyway slot 96 cut in the upper end of the rotor sleeve 78 to provide a positive drive connection for the distributor rotor unit 90 from the engine driven rotor shaft 26. Reinforcement ribs 98 are provided on the upper surface of the disc 91, which further includes a radially outwardly disposed, upstanding mount or pedestal 100, a centrally located tubular post 101, and an outwardly disposed raised pad 102 located diametrically opposite the pedestal 100. Pedestal 100 provides an elevated rectangular mount for the blade-like distributor rotor electrode 92 and an overlying flat conductive spring 104, which overhangs the post 101 and is attached to the top of the pedestal with the electrode 92 by an attachment screw 105. Pad 102 provides a mass of material for balancing the disc, while the post 101 provides a stop for the spring 104.

Embedded in the plastic material of and carried on the flat underside of the rotor disc 91 is a thin, rigid metallic stiffener or reinforcement plate 110. Plate 110 is of slightly lesser diameter than and is disposed inwardly of the periphery of the overhanging disc 91 and has a plurality of openings therein for flow of the plastic material of the disc therethrough during the molding of the disc to affix the stiffener plate 110 thereto. The central portion of the stiffener plate is pierced or lanced with a three-sided rectangular slit and is struck out of the plane thereof to form a rectangular opening 111 therein, which surrounds or circumscribes the exterior of the tubular sleeve 94. The struck out central portion of the plate is then bent downwardly to form a depending tab 114, which extends into the interior of the tubular sleeve 94 to contact the upper end of the metallic sleeve 78, as shown in FIGS. 1 and 9.

The stiffener plate 110, which is formed of a flat rigid piece of 1010 SAE steel, reinforces and stabilizes the rotor disc 91 and reduces the amount of material employed in the formation thereof in addition to providing a carrier for the interrupter vanes 93, which are of integral formation with the plate. The vanes 93 are provided in a number corresponding to the number of cylinders in the engine in which the distributor is employed and are equally angularly spaced around the circumferential periphery or edge of the plate 110 with intervening equally spaced arcuate openings 112 between adjacent vanes and are displaced the same radial distance from the center of the plate. As shown in FIGS. 1 and 9, the vanes are of arcuate-shaped cross-section and depend downwardly axially from the plane of the plate 110 to extend into the space or slot 55 between the magnet 53 and Hall element 56 of the pickup sensor 50 when the distributor rotor unit 90 is mounted in place in the distributor.

The plastic distributor cap 14 is attached to the distributor housing 12 as previously described and is formed with a plurality of upwardly, longitudinally extending towers 140, 142 each of which has an electrically conductive electrode 144, 146 inserted or integrally moulded therein. Each tower receives a different one of a plurality of ignition cables or conductors (not shown) by which the centrally located tower electrode 146 is connected to the high tension side of the vehicle ignition coil 81 and the radially outwardly located tower electrodes 144 are connected to the corresponding spark plugs 83 of the engine.

At its lower or inner end projecting into the interior of the distributor cap, the central electrode 146 is swaged about a graphite sphere 148, which contacts the inwardly located end of the spring 104 to conduct the high tension ignition energy from the ignition coil to the blade-like distributor electrode 92 carried on the distributor rotor unit 90. The outwardly located end of the distributor rotor blade is spaced slightly from the lower ends of the inserts 144, which constitute the output or spark plug associated electrodes of the distributor, for transfer of high tension energy from the distributor blade 92 to an adjacent output electrode in the form of an electrical spark discharge therebetween. It will be noted that the distance between the rotor blade 92 and an adjacent interrupter vane 93 on the stiffener plate 110 as measured along (a) the vertical frontal surface of the raised pedestal 100, (b) the upper and lower surfaces of the portion of the disc member 91 overhanging the stiffener plate 110 and (c) the thickness of the plastic disc member 91 is greater than the distance between the rotor blade and an adjacent output electrode even when the rotor blade is positioned between an adjacent pair of output electrodes, as shown in FIG. 2, thereby decreasing the possibility of accidental arc flashover between the distributor blade and the interrupter vanes under normal loaded, closed circuit operating conditions of the ignition system.

However, under unloaded conditions of the ignition coil or an open circuit or disconnected condition of an engine spark plug, there is a possibility of drawing an arc from the distributor blade due to the highly ionized and electrostatically charged atmosphere within the distributor. This atmosphere, as previously mentioned, may deleteriously affect and be harmful to the charge-sensitive semiconductor Hall Sensor element and the integrated circuitry carried on the ceramic substrate 58 of the pickup 50. Moreover, should the integrated circuit chip module carried on the substrate be struck by an arc discharge from the distributor blade, as can occur for example during an unloaded condition of the ignition coil or open circuit condition of an engine spark plug, the expensive delicate circuitry thereon can be damaged.

It is for these reasons, therefore, that the interrupter vanes 93 are grounded through the integrally formed grounding tab connection 114 on the stiffener plate to the rotor shaft 26 through sleeve 78, which are at the electrical ground or reference potential of the return circuit side of the battery 82 and thus provide a path to ground for electrostatic charges within the distributor. Any stray or accidential electrical discharge that might emanate from the distributor rotor blade electrode under the aforementioned or related conditions will be diverted away from the delicate semiconductor components of the pickup and associated electronic circuitry and conducted instead to ground through the interrupter vanes and rotor shaft. The increased spacing or surface distance between the raised distributor electrode and adjacent interrupter vane also aids in attenuation of and lessening the tendency of any spark formation therebetween. The pickup structure may thus be protected by the above described mechanical and electrical expedients and design considerations of the distributor rotor unit itself without the need for additional protective circuitry within the pickup structure or in the external control unit.

From the foregoing it will be seen that the described distributor is characterized by and features an integral rotor and shutter assembly which greatly facilitates and simplifies the installation and removal of the rotor and shutter unit for inspection and replacement and reduces the cost of manufacture and fabrication thereof. The rotor and shutter assembly includes a stiffener plate, which permits the use of a thin rotor disc to reduce the mass of the distributor and enables the shutter to be molded and secured to the rotor disc. The stiffener plate rigidifies and strengthens the rotor disc and prevents warpage and out-of-roundness that would otherwise be encountered by the use of a thin rotor disc. In addition, it provides a carrier for the interrupter vanes of the shutter for the Hall Sensor assembly and by reason of the electrical ground return circuit path provided thereby, it also affords a measure of protection to the Hall Sensor and electronic assembly from arc flashover within the distributor.

While the distributor has been illustrated for use in a four cylinder engine, the principles employed therein may be applied to such distributors for larger engines as well.

What is claimed is:

1. A breakerless ignition distributor for an electronic ignition system including an ignition coil energizable from an electrically grounded source of low tension electrical energy through a triggerable electronic control switching unit to supply high tension electrical energy to the spark plugs of an internal combustion engine at various angular positions of the crankshaft of the engine, said distributor comprising in combination, a metallic bowl-shaped body having a stem portion by which it is mounted on a stationary portion of the engine, an insulative cap releasably attached to the distributor body and having a central electrode for electrical connection to the high tension side of said ignition coil and a plurality of output electrodes disposed in a circular array about said central electrode and adapted to be connected to different corresponding ones of the engine spark plugs, a steel rotor shaft extending through and journalled in the distributor body stem portion, said rotor shaft mechanically coupled at one end for rotation from the engine and electrically grounded therethrough to said source of low tension energy, a low mass distributor rotor unit including a thin insulative disc member of an axial thickness less than its diameter and mounted on the other end of said rotor shaft, said disc member carrying an electrically conducting, radially extending rotor blade on one side thereof and a broad continuous metallic stiffener plate molded on the other side thereof, the inner end of said rotor blade electrically contacting said central cap electrode and its outer end spaced from an oppositely positioned output cap electrode for transfer of high tension energy in the form of an electrical spark discharge therebetween, a mounting plate positioned in said distributor body, electrical pickup means for sensing the angular position of the engine crankshaft and developing an electrical triggering control signal for said electronic control switching unit, said pickup means including a source of excitation and electrical semiconductor sensor means both carried on said mounting plate and insulated from the distributor body, said sensor means responsive to excitation from said excitation source and spaced therefrom by an air gap therebetween, and excitation source interrupting means carried on said distributor rotor disc member and including a plurality of equally arcuately and radially centrally displaced, electrically conducting exposed vane elements integrally formed on and depending from said stiffener plate to extend into said air gap between and be successively conveyed past said excitation source and said sensor means, and rotor shaft contacting means provided on said stiffener plate to place said interrupter vanes at the electrical potential of said rotor shaft and divert any electrical energy, which may be accidentally discharged from the rotor blade, away from said electrical semiconductor sensor means, and to conduct it instead through the interrupter vanes and rotor shaft, thereby to protect said electrical semiconductor sensor means from such electrical discharge.

2. A breakerless ignition distributor in accordance with claim 1 above wherein said pickup means includes a permanent magnet excitation source and a Hall Element sensor exposed to the magnet excitation source within the distributor.

3. A breakerless ignition distributor in accordance with claim 2 above wherein said permanent magnet is located radially inwardly of said interrupter vanes and between said rotor shaft and said interrupter vanes and wherein said Hall Element sensor is located radially outwardly of said interrupter vanes and between the vanes and the insulative cap.

4. A combined interrupter and high tension low mass distributor rotor unit readily removably receivable on one end of a rotor shaft of an ignition distributor driven from an engine of an automotive-type vehicle, said distributor being of the breakerless electronic ignition variety triggerable by an electrical control signal derived from an electrical pickup device housed within the distributor, said pickup including a source of excitation, sensor means responsive to and spaced from said excitation source, and excitation interrupting means carried on said distributor rotor unit to be interposed between and conveyed past said excitation source and said sensor means with rotation of said rotor unit, said rotor unit comprising a thin insulative disc member having an axially extending, cylindrical tubular sleeve mounting portion on one side thereof for removably attaching the disc member to the said one end of said engine driven distributor rotor shaft, a generally radially projecting, blade-like distributor electrode formed of electrically conductive material and mounted on the other side of said disc member, and a generally circular, metallic stiffener plate carried on and molded to said one side of said disc member in surrounding relation to said cylindrical mounting portion thereon and including a plurality of equally angularly spaced, arcuate metallic, exposed vane elements integrally formed on and depending from said stiffener plate to act as said excitation source interrupting means for said electrical pickup device and metallic contact means on said stiffener plate to engage the distributor rotor shaft and place the interrupter vanes carried on the stiffener plate at the electrical potential of the rotor shaft when the rotor unit is mounted thereon in the distributor.

5. A breakerless ignition distributor in accordance with claim 4 above, wherein said stiffener plate is a thin circular disc of slightly lesser diameter than the disc member.

6. A combined interrupter and high tension, low mass distributor rotor unit in accordance with claim 4 above wherein the axial thickness of said disc member is less than 10 percent of its diameter.

7. A combined interrupter and high tension, low mass distributor rotor unit in accordance with claim 4 above, wherein said metallic contact element is an integrally formed tab depending axially from said stiffener plate.

8. A combined interrupter and high tension, low mass distributor rotor element in accordance with claim 4 above, wherein said stiffener plate has a plurality of axially extending openings therein for plastic flow of the insulative material of the disc member therethrough during the molding of the disc affixing the plate and interrupter vanes thereto.

9. A combined interrupter and high tension, low mass distributor rotor element in accordance with claim 7 above wherein said tab is struck out from a central portion of the stiffener plate leaving an elongated centrally located opening therein circumscribing said cylindrical mounting tubular sleeve and wherein said tab is received within and extends into said tubular sleeve of said insulative disc member to contact said rotor shaft when the rotor element is in place thereon in said distributor.

10. A combined interrupter and high tension, low mass distributor rotor unit in accordance with claim 4 for a distributor having a distributor cap with a high tension central electrode adapted to contact said distributor blade electrode and a plurality of output electrodes arrayed about said central electrode in a circular path radially outwardly spaced from the rotational path of said distributor blade electrode for transfer of high tension energy therefrom in the form of a spark discharge to an adjacent output electrode, said rotor disc member having a raised pedestal on the said other side thereof for mounting said distributor blade electrode and spacing it from said stiffener plate and an adjacent interrupter vane carried on the said one side of the disc member a distance which, measured along an axially directed frontal surface of the pedestal and the axial thickness of the disc member, is larger than the greatest distance between the distributor blade electrode and an adjacent output electrode when the rotor blade is positioned between a pair of output electrodes.

11. A combined interrupter and high tension, low mass distributor rotor unit in accordance with claim 10 above wherein the rotor disc member includes a mass of material disposed generally diametrically opposite the pedestal on which the distributor blade electrode is mounted, thereby to balance the rotor disc member.

* * * * *